US005958806A

United States Patent [19]

Jensen et al.

[11] Patent Number: 5,958,806

[45] Date of Patent: Sep. 28, 1999

[54] CARDABLE HYDROPHOBIC POLYOLEFIN FIBRES COMPRISING CATIONIC SPIN FINISHES

[75] Inventors: Arne Jensen, Varde, Denmark; Katharine Dyrmose-Jensen, Thann, France; Lydia Dahl Clausen, Lynge; Bjørn Marcher, Greve, both of Denmark

[73] Assignee: FiberVisions A/S, Varde, Denmark

[21] Appl. No.: 08/669,533

[22] PCT Filed: Jan. 13, 1995

[86] PCT No.: PCT/DK95/00024

§ 371 Date: Aug. 19, 1996

§ 102(e) Date: Aug. 19, 1996

[87] PCT Pub. No.: WO95/19465

PCT Pub. Date: Jul. 20, 1995

[30] Foreign Application Priority Data

Jan. 14, 1994 [DK] Denmark ..... 0070/94

[51] Int. Cl.[6] ..... D06M 13/02; D06M 15/227; D06M 13/463; D06M 13/402

[52] U.S. Cl. ..... 442/401; 442/79; 442/84; 442/85; 442/59; 264/130

[58] Field of Search ..... 442/59, 47, 84, 442/85, 401; 264/130

[56] References Cited

U.S. PATENT DOCUMENTS 4,082,887 4/1978 Coates .

4,423,105 12/1983 Dillarstone et al. .

FOREIGN PATENT DOCUMENTS 0557024 2/1993 European Pat. Off. .
0576896 6/1993 European Pat. Off. .
2351152 12/1977 France .
59-43171 3/1984 Japan .
94 20664 9/1994 WIPO .

*Primary Examiner*—Marian C. Knode
*Assistant Examiner*—Brenda G. Brumback
*Attorney, Agent, or Firm*—Birch, Stewart, Kolasch & Birch, LLP

[57] ABSTRACT

A method for producing cardable, hydrophobic polyolefin-based staple fibers by applying to spun filaments a first spin finish comprising at least one cationic antistatic agent, in particular a quaternary ammonium salt, stretching the filaments, applying to the stretched filaments a second spin finish in the form of a dispersion comprising at least one hydrophobic lubricant selected from a fatty acid amide condensation product and a hydrocarbon wax, the second spin finish optionally further comprising a polydiorganosiloxane in an amount of up to 15% by weight, and crimping, drying and cutting the filaments to obtain staple fibers; as well as textured, cardable, polyolefin-based staple fibers prepared by the method and hydrophobic nonwoven materials produced from such fibers. The fibers are able to be carded at extremely high speeds and are particularly suitable for use in the preparation of thermally bonded hydrophobic nonwoven fabrics in which a dry, water-repellant surface which can function as a liquid barrier is desired, e.g., for disposable diapers, feminine hygienic products and medical products.

33 Claims, No Drawings

CARDABLE HYDROPHOBIC POLYOLEFIN FIBRES COMPRISING CATIONIC SPIN FINISHES

This application is the National Stage of International Application No. PCT/DK95/00024, filed Jan. 13, 1995 under 35 U.S.C. 371.

FIELD OF THE INVENTION

The present invention relates to cardable and thermobondable polyolefin-based synthetic fibres treated with hydrophobic spin finishes comprising a cationic antistatic agent and a hydrophobic lubricant, a method for producing the fibres, and nonwoven products prepared from the fibres.

The fibres, which have the advantage of being able to be carded at extremely high speeds, are particularly suitable for use in the preparation of thermally bonded hydrophobic nonwoven fabrics in which a dry, water repellant surface which can function as a liquid barrier is desired, e.g. for disposable diapers and feminine hygienic products. The fibres are also suitable for the preparation of thermally bonded nonwoven fabrics for medical use in which a dry, water repellant surface is desired in order to reduce bacterial penetration, for example medical gowns and drapes.

BACKGROUND OF THE INVENTION

A number of polyolefin-based hydrophobic synthetic fibres are known, for example hydrophobic textile fibres with dirt and stain resistant properties. However, such fibres generally contain cationic antistatic agents that are undesirable or unsuitable for personal hygiene and medical products for toxicological reasons, since they often exhibit skin irritating properties due to their low pH. Also, some components may during use release di- or tri-ethanolamine, which is suspected of causing allergic reactions. It has previously proved difficult to produce fibres for hygienic or medical use having good cardability properties together with satisfactory hydrophobic properties. This is particularly important for the many applications in which it is desired that hydrophobic fibres may be carded using high carding speeds.

Hygienic products such as disposible diapers, sanitary napkins and adult incontinence pads generally have barriers through which fluids absorbed by the absorbent core are not able to penetrate, e.g. in the form of side guards, other structural elements, or as back sheet material opposite to the skin. Such barriers may comprise a nonwoven material prepared from hydrophobic staple fibres or a spunbonded material prepared directly from a hydrophobic polymer. However, spunbonded materials are very flat and film-like, and do not have the soft, uniform, textile-like comfort that one finds in nonwovens. Spunbonded fabrics are therefore not the optimal choice for liquid barriers designed to be in contact with the skin of the user. Also, spunbonded nonwovens have a non-uniform distribution of fibres, which results in weak areas (holes) that limit the liquid barrier properties of the fabrics, so that web uniformity becomes the limiting factor for the hydrophobic characteristics. As for nonwovens prepared from staple fibres, these tend not to be sufficiently hydrophobic for such liquid barriers, due to the fact that during the spinning process, the fibres are treated with a "spin finish" which facilitates the spinning process by lubricating the fibres and making them antistatic. However, as a result of the spin finish treatment, in particular the use of an antistatic agent, which by nature is more or less hydrophilic, the fibres become somewhat hydrophilic, which in the present context is undesirable. On the other hand, fibres with the desired degree of hydrophobicity have generally had suboptimum antistatic properties.

EP 0 557 024 A1 describes polyolefin fibres treated with an antistatic agent which is a neutralized phosphate salt, and optionally with a hydrophobic lubricant selected from mineral oils, paraffinic waxes, polyglycols and silicones, the fibres having an hydrostatic head value of at least 102 mm. WO 94/20664 describes a method for producing cardable, hydrophobic polyolefin-based staple fibres using two spin finishes, in which the second spin finish is a dispersion comprising an antistatic agent, preferably an anionic or non-ionic antistatic agent, and, as a hydrophobic agent, a natural or synthetic hydrocarbon wax or wax mixture, and optionally a silicone compound.

The present invention represents a different and highly effective approach to the problem of providing polyolefin staple fibres with an optimum combination of hydrophobic and antistatic properties, thereby making them suitable for the production, in particular by means of high-speed carding, of nonwovens with optimum strength and hydrophobic characteristics. Furthermore, the invention is based on the use of substances which are not irritating to the skin.

An object of the present invention is therefore to provide hydrophobic thermobondable synthetic fibres, in particular for hygienic applications, with both optimum hydrophobic and antistatic properties, and thus with improved carding properties suitable for preparation of nonwovens showing superior strength. A further object of the present invention is to improve the application and distribution of spin finish on the fibres, thus improving fibre uniformity, allowing increased carding speed and improved web uniformity in the carding process, which in turn results in nonwovens with improved hydrophobic properties.

BRIEF DISCLOSURE OF THE INVENTION

In one aspect, the present invention relates to a method for producing cardable, hydrophobic polyolefin-based staple fibres, the method comprising the following steps:

a. applying to spun filaments a first spin finish comprising at least one cationic antistatic agent, b. stretching the filaments, c. applying to the stretched filaments a second spin finish in the form of a dispersion comprising at least one hydrophobic lubricant selected from a fatty acid amide condensation product and a hydrocarbon wax, d. crimping the filaments, e. drying the filaments, and f. cutting the filaments to obtain staple fibres.

Further aspects of the invention relate to texturized, cardable, polyolefin-based fibres produced by the above method, as well as hydrophobic nonwoven materials containing such fibres.

The fibres of the present invention have been found to have excellent hydrophobic properties as well as excellent anti-static properties and can therefore be carded at high carding speeds comparable to carding speeds typically used for hydrophilic staple fibres. The fibres' suitability for high-speed carding is also due to their controlled fibre/fibre and fibre/metal friction properties obtained by varying the composition of the spin finishes, especially the second spin finish. It has furthermore been found that webs prepared from the fibres have a uniform distribution of the fibres in both the machine direction and the transverse direction, and that when these webs are thermobonded by calender bonding non-wovens with improved strength and excellent hydrophobicity are obtained.

In anionic systems it is necessary to use a large amount of a hydrophobic lubricant, often a silicone compound, in order to obtain a reasonably high degree of hydrophobicity. With the cationic system of the present invention, however, the inherent hydrophobicity of the antistatic agent and the hydrophobic lubricant is so good that the desired hydrophobic properties can be obtained without or with only a small amount of silicone. This is an important advantage, since reducing the amount of silicone gives a greater and more uniform fibre/fibre friction, which in turn facilitates high speed carding.

Antistatic agents of the quaternary ammonium salt type are commonly used for polyolefin fibres outside the hygienic sector, in particular for bulk continuous filaments or staple fibres intended for use in e.g. carpets or technical applications, rather than for hygienic applications or clothing. According to the present invention it has been found that fatty acid amide condensates and natural or synthetic hydrocarbon waxes can be advantagously used in combination with cationic antistatic agents, the fatty acid amide condensates and waxes functioning as hydrophobic lubricants, i.e. providing hydrophobic properties as well as the desired frictional properties.

Certain types of prior art polypropylene fibres are produced using cationic antistatic agents, esterified wax components and a large amount of alkoxylated emulsifiers. However, the spin finishes of such fibres typically contain a relatively large amount of acetic acid or another acid that must be evaporated during bonding to avoid acid-induced skin irritation. In contrast, the fibres of the present invention are prepared using non-alkoxylated emulsifiers without esterified wax components, and also without the use of large amounts of an acid.

DETAILED DISCLOSURE OF THE INVENTION

The term "polyolefin-based" refers to the fact that the fibres of the present invention are produced from a polyolefin or a copolymer thereof, including isotactic polypropylene homopolymers as well as random copolymers thereof with ethylene, 1-butene, 4-methyl-1-pentene, etc., and linear polyethylenes of different densities, such as high density polyethylene, low density polyethylene and linear low density polyethylene. The melts used to produce the polyolefin-based fibres may also contain various conventional fibre additives, such as calcium stearate, antioxidants, process stabilizers, and pigments, including whiteners and colourants such as $TiO_2$, etc.

The hydrophobic fibres may be either monocomponent or bicomponent fibres, the latter being for example sheath-and-core type bicomponent fibres with the core being located either eccentrically (off-center) or concentrically (substantially in the center). Bicomponent fibres will typically have a core and sheath which comprise, respectively, polypropylene/polyethylene, high density polyethylene/linear low density polyethylene, polypropylene random copolymer/polyethylene, or polypropylene/polypropylene random copolymer.

Fibres prepared according to the present invention may be white (unpigmented) or coloured (pigmented).

The spinning of the fibres is preferably accomplished using conventional melt spinning (also known as "long spinning"), in particular medium-speed conventional spinning. Conventional spinning involves a two-step process, the first step being the extrusion of the melts and the actual spinning of the fibres, and the second step being the stretching of the spun fibres, in contrast to so-called "short spinning", which is a one-step process in which the fibres are both spun and stretched in a single operation.

For spinning, the melted fibre components are led from their respective extruders, through a distribution system, and passed through the holes of a spinnerette. The extruded melts are then led through a quenching duct, where they are cooled and solidified by a stream of air, and at the same time drawn into filaments, which are gathered into bundles of typically several hundred filaments. The spinning speed after the quenching duct is typically at least about 200 m/min, more typically about 400–2500 m/min. After having solidified, the filaments are treated with the first spin finish. This is typically performed by means of lick rollers, but alternative systems, such as spraying the bundles of filaments or dipping them in the spin finish, are also suitable.

Stretching in a long spin process is performed using so-called off-line stretching or off-line drawing, which, as mentioned above, takes place separately from the spinning process. The stretching process typically involves a series of hot rollers and a hot air oven, in which a number of bundles of filaments are stretched simultaneously. The bundles of filaments pass first through one set of rollers, followed by passage through a hot air oven, and then passage through a second set of rollers. Both the hot rollers and the hot air oven typically have a temperature of about 50–140° C., e.g. about 70–130° C., the temperature being chosen according to the type of fibre, e.g. typically 115–135° C. for polypropylene fibres, 95–105° C. for polyethylene fibres, and 110–120° C. for polypropylene/polyethylene bicomponent fibres. The speed of the second set of rollers is faster than the speed of the first set, and the heated bundles of filaments are therefore stretched according to the ratio between the two speeds (called the stretch ratio or draw ratio). A second oven and a third set of rollers can also be used (two-stage stretching), with the third set of rollers having a higher speed than the second set. In this case the stretch ratio is the ratio between the speed of the last and the first set of rollers. Similarly, additional sets of rollers and ovens may be used. The fibres of the present invention are typically stretched using a stretch ratio of from about 1.05:1 to about 6:1, e.g. from 1.05:1 to 2:1 for polypropylene fibres, and from 2:1 to 4.5:1 for polyethylene fibres and polypropylene/-polyethylene bicomponent fibres, resulting in an appropriate fineness, i.e. about 1–7 dtex, typically about 1.5–5 dtex, more typically about 1.6–3.4 dtex.

After stretching, the bundles of filaments are treated with the second spin finish, for example using lick rollers or by spraying or dipping. The filaments may optionally be heated prior to crimping, e.g. by means of steam, either superheated or saturated, or infrared heaters, etc. to increase the temperature and melt the hydrophobic spin finish components. Ideally, it would be preferable to apply the spin finish dispersions without melting the hydrophobic lubricant. However, the spin finish components should be in the form of a dispersion at the time of application to prevent coalescence of the particles or droplets of the hydrophobic lubricant, and afterwards it is therefore generally necessary to melt these components in order to ensure a uniform distribution on the fibres. Melting of the hydrophobic lubricant preferably takes place before the crimper, but it can also take place in the crimper itself or during the subsequent drying step. The energy used to heat and melt the hydrophobic lubricant may come from the filament tow itself, which becomes heated during the stretching process, or, alternatively, it can come from e.g. steam or infrared radiation as explained above.

Friction in the crimper (which in turn influences web cohesion) can be regulated to a certain extent by regulation of the process parameters, in particular pressure in the stuffer box chamber. However, this is only possible within certain boundries, the boundries being defined by the composition of the spin finishes. Further information on the effect of the spin finish components on fibre/fibre and fibre/metal friction is provided below.

The stretched fibres are normally texturized (crimped) in order to make the fibres suitable for carding by giving them a "wavy" form. An effective texturization, i.e. a relatively large number of crimps in the fibres, allows for high processing speeds in the carding machine, e.g. at least 80 m/min, typically at least about 100 m/min, and in many cases at least 150 m/min or even 200 m/min or more, and thus a high productivity.

Crimping is typically carried out using a so-called stuffer box. The bundles of filaments are led by a pair of pressure rollers into a chamber in the stuffer box, where they become crimped due to the pressure that results from the fact that they are not drawn forward inside the chamber. The degree of crimping can be controlled by the pressure of the rollers prior to the stuffer box, the pressure and temperature in the chamber, and the thickness of the bundle of filaments. As an alternative, the filaments can be air-texturized by passing them through a nozzle by means of a jet air stream. In certain cases, i.e. for asymmetric bicomponent fibres, crimping devices may be eliminated, since heat treatment of such fibres, which releases tension in the fibres, leads to contraction and thus three-dimensional self-crimping.

The fibres of the present invention are typically texturized to a level of about 5–15 crimps/cm, typically about 7–12 crimps/cm (the number of crimps being the number of bends in the fibres).

After the fibres have been crimped, e.g. in a stuffer box, they are typically fixed by heat treatment in order to reduce tensions which may be present after the stretching and crimping processes, thereby making the texturization more permanent. Fixation and drying of the fibres are important factors for the hydrophobicity of the final product. In particular, it is important that the drying unit, e.g. drum dryer, oven, drying and heat setting channel, etc., has a uniform distribution of the hot air, since this results in a low and uniform distribution of moisture in the fibres, which in turn effects the hydrophobicity of the final product. The residual moisture content is preferably less than 2.0%, more preferably less than 1.5% by weight based on the weight of the fibre. Fixation and drying of the fibres may take place simultaneously, typically by leading the bundles of filaments from the stuffer box, e.g. via a conveyer belt, through a hot air oven. The temperature of the oven will depend on the composition of the fibres, but must obviously be below the melting point of the fibre polymer or (in the case of bicomponent fibres) the low melting component. During the fixation the fibres are subjected to a crystallization process which "locks" the fibres in their crimped form, thereby making the texturization more permanent. The heat treatment also removes a certain amount of the water from the spin finishes. The drying process allows any wax component or other hydrophobic lubricant to melt and become distributed uniformly on the surface of the filaments. For hydrophobic lubricants that are already liquid, for example silicone compounds, the heat treatment provides a reduction in viscosity, which allows a more uniform distribution of such compounds. The filaments are typically dried at a temperature in the range of 90–130° C., e.g. 95–125° C., depending on factors such as the type of fibre.

The fixed and dried bundles of filaments are then led to a cutter, where the fibres are cut to staple fibres of the desired length. Cutting is typically accomplished by passing the fibres over a wheel containing radially placed knives. The fibres are pressed against the knives by pressure from rollers, and are thus cut to the desired length, which is equal to the distance between the knives. The fibres of the present invention are typically cut to staple fibres of a length of about 18–150 mm, more typically about 25–100 mm, in particular about 30–65 mm, depending on the carding equipment and the fineness of the fibres. A length of about 38–40 mm will thus often be suitable for a fibre with a fineness of about 2.2 dtex, while a length of 45–50 mm is often suitable for a 3.3 dtex fibre.

Quite generally, the main requirements for a spin finish for spinning and stretching polymer fibres include the following:

1. It should contain an amount of antistatic agent which ensures that the fibres do not become electrically charged during the spinning and stretching process or during the carding process; anionic, cationic and non-ionic antistatic agents are all employed in spin finishes (although, as explained above, cationic antistatic agents have generally been unsuitable for use in fibres to be used in hygienic absorbent products due to the skin irritating properties of these agents).
2. If necessary, it should contain an amount of cohesion conferring agent sufficient to ensure that the filaments are held together in bundles, allowing them to be processed without becoming entangled; neutral vegetable oils, long chained alcohols, ethers and esters, sarcosines and non-ionic surface active agents are often employed for this purpose.
3. It should contain components, typically hydrophobic lubricants, which regulate both fibre/fibre and fibre/metal friction during the production process, so that the filaments do not become worn or frayed during processing. In particular, fibre/metal friction during the spinning stage, fibre/metal friction against the stretch rollers, and fibre/fibre and fibre/metal friction in the crimper need to be regulated.
4. Water plus emulsifiers or surface active agents which keep the more or less lipophilic components in the aqueous solution are normally necessary. Solvents other than water should be avoided if at all possible to eliminate possible environmental hazards.

Spin finishes also serve to regulate the fibre/fibre and fibre/metal friction during carding, and spin finishes used for spinning and stretching are generally adapted so that the fibres do not require any further processing before carding.

Antistatic agents are a necessary component for all spin finishes used in the production of polyolefin fibres. Such antistatic agents are by nature polar and therefore also more or less hydrophilic, which in principle is a necessary evil one must live with in the case of spin finishes that are otherwise hydrophobic. In such cases, the amount of antistatic agent is reduced to a minimum in order to preserve the hydrophobic nature of the spin finish. One way of achieving this is by using a highly effective antistatic agent, of which only a small amount is necessary to obtain the desired antistatic effect. However, commonly employed anionic antistatic agents such as phosphoric acid esters are not particularly effective, since they for hydrophobic fibres often contain long alkyl chains, whereby the concentration of phosphor groups is relatively low. Since the relative number of these phosphor groups determines the antistatic properties, it follows that such agents are relatively ineffective. The following typical values for normal antistatic components serve as a guideline for the relative efficiency of their antistatic properties: inorganic salts 100, cationic 80–100, anionic 75–90, nonionic 50–70, fixing agents 30, mineral oils and silicones 0–10, lubricants 30–50.

Cationic antistatic agents are known to be more effective than anionic agents and can therefore be used in much smaller concentrations, thereby preventing or minimizing hydrophilic properties in the hydrophobic spin finish, but as mentioned above, such cationic antistatic agents have not been suitable for personal hygiene and medical products for toxicological reasons.

The present invention is based on spin finishes used in connection with both the spinning and stretching steps which fulfil the requirements listed above with regard to the content of antistatic agent, hydrophobic lubricant(s), water and optional cohesion conferring agent, as well as regulation of fibre/fibre and fibre/metal friction. These spin finishes have the further advantage that they function as a processing aid during carding and thus provide the fibre/fibre and fibre/metal friction necessary to obtain sufficient carding of the fibres. As a result, a carding web with a uniform distribution of the fibres is obtained, even when using relatively high carding speeds.

In the method of the present invention, the majority or even all of the antistatic agent is applied in the spinning stage. The use of the cationic antistatic agent will normally be unneccessary in the stretching stage, and is preferably avoided. The reason for this is that cationic antistatic agents typically form a stable foam upon stirring or agitation, and they also have a relatively high viscosity. The amount of cationic antistatic agent is therefore preferably kept to a minimum in the second spin finish to reduce the viscosity and eliminate or reduce air bubbles, both of which lead to a non-uniform application of the spin finish. When the second spin finish comprises a cationic antistatic agent, this is therefore preferably present in an amount of at the most 20%, more preferably at the most 10%, based on the total active content of the second spin finish.

The total concentration of the active components (i.e. antistatic agent, hydrophobic lubricant(s), emulsifier, cohesion conferring agent) is typically lower in the first spin finish (generally about 0.7–2.5% active content) than in the second spin finish (generally about 4–12% active content), and the viscosity of the first spin finish is thus also normally lower. It is therefore advantageous to employ any high viscosity components in the dispersion with the lowest viscosity, i.e. in the first spin finish.

When the hydrophobic lubricant is a wax or a silicone compound, this is only applied in the stretching stage. However, when the hydrophobic lubricant is a fatty acid amide condensation product, it may be also be applied in the spinning stage. There are several reasons for choosing this approach. First of all, the use of wax as a hydrophobic lubricant during spinning results in problems for both spinning and stretching:

1. During spinning, the fibre/metal friction will be increased and part of the wax components will be deposited on various machine surfaces which are in contact with the filament bundles. Deposition of wax during spinning will also cause the bundle of filaments to be so sticky that it will partially stick to itself. If this happens, the fibre bundles will be difficult to take up out of the cans (boxes in which the bundles are stored until a number of bundles are ready to be stretched simultaneously) when they are to be stretched in the two-step process.
2. During stretching, wax deposits will also be formed on the heated rollers and other machine parts that are in contact with the bundles. This is due to the fact that the bundle of filaments is heated during the stretching process. At elevated temperatures some of the water will evaporate from the applied spin finish, and a film of melted wax will easily be deposited on the rollers, etc. If this happens, friction between the bundles of filaments and the surface of the rollers will be reduced to a level below that which is necessary for maintenance of the drawing forces necessary to stretch the fibres. If, as a result, the fibres slide along the surface of the rollers, they will obviously not become stretched.

The use of silicone compounds as hydrophobic lubricants during the spinning process would also give problems for both spinning and stretching:

1. During spinning, silicone would reduce fibre/metal friction, so that the bundles of filaments would slide along the various drive rollers rather than being moved forward by the rollers. As a result, it would not be possible to pull the fibres out of the spinnerette at a predetermined and constant speed. This applies especially at the high speeds used in conventional spinning.
2. During stretching, silicone applied in the spinning stage would have the same negative effect as wax. Friction between the bundle of filaments and the stretch rollers would be reduced, resulting in the well-known slip problems caused by silicone.

By only applying a small amount of relatively hydrophobic cationic antistatic agent and a very small amount, if any, of a cohesion conferring agent during the spinning stage (i.e. without a hydrophobic lubricant in any significant amount), the above-mentioned processing problems are avoided. The cationic antistatic agent should have sufficient antistatic properties, should contribute to the cohesion of the filaments, and should not have such a high molecular weight that it leads to problems with deposits on the machinery.

The cationic antistatic agents used according to the invention have a particular advantage that is related to the fact that polyolefins, and particularly polypropylene during processing by long spin techniques, become partially oxidized on the surface. Thus, while polyolefins are known to be hydrophobic, they can in certain cases have surface properties that are not strictly hydrophobic. As a result of this partial oxidation, some hydroxy and carboxy groups as well as aldehyde and ketone groups are introduced on the surface. In addition to being polar and thus hydrophilic, such polymer bound groups are also anionic. This means that they will in principle repel any aqueous solution of anionic antistatic agent that one attempts to apply to the fibres. This leads to a non-uniform, less efficient coating of the antistatic agent on the fibre surface, and thus poorer antistatic properties, as well as the risk that agglomerations of antistatic agent will be deposited on the equipment during carding. Also, there is a risk of having regions on the surface that are relatively hydrophilic and other regions that are hydrophobic. The presence of such hydrophilic regions would tend to conduct liquids through a nonwoven, thus diminishing the hydrophobic properties. In the case of cationic (positively charged) antistatic agents, however, the oppositely (i.e. negative) charged groups on the polymer surface will ensure a uniform distribution of the antistatic agent on the fibre surface.

This in turn contributes to the efficiency of the cationic agents, allowing the obtainment of improved antistatic properties necessary to be able to card the produced fibres at high carding speeds of e.g. 200 m/min.

Since a relatively small amount of the cationic antistatic agent is sufficient to obtain the desired antistatic effect, the fibres will be more hydrophobic compared to fibres prepared using a prior art anionic antistatic agent. As a result, it is possible to reduce the amount of the hydrophobic lubricant (e.g. silicone) which is otherwise added to render the fibres more hydrophobic. As mentioned above, the use of silicone compounds, which tends to make the fibre surface slippery, has a number of disadvantages in terms of reduction of fibre/fibre and fibre/metal friction. As a result, silicone-treated fibres tend to be difficult to texturize and therefore also difficult to card at high carding speeds.

Cationic antistatic agents have the further advantage that they are less sensitive to humidity than the commonly employed anionic alkyl phosphate salts during the subsequent processing of the fibres. As a result of this sensitivity of antistatic agents based on alkyl phosphate salts, the carding of fibres treated with these agents must normally be carried out under controlled relative humidity (e.g. 65%).

The cationic antistatic agents used according to the present invention are typically quaternary ammonium salts. Such cationic antistatic agents may be included in the polyolefin as e.g. alkyl alkanol amines, alkoxylated allylene diamines, or the hydroxyethyl-dodecyl-oxypropylamine salt of hydroxy-propionic acid, or as quaternary ammonium salts such as stearyl polyether acetal ammonium salt. (Ahmed, *Polypropylene Fibres—Science and Technology,* Elsevier Scientific Publishing Co., 1982, p. 375). Fatty acid amine condensates provide good antistatic behaviour and also high friction under wet conditions, which aids in the obtainment of good texturization in a stuffer box crimper.

The pH of prior art spin finishes comprising a cationic antistatic agent or a fatty acid amide condensate is generally somewhat acidic, typically below pH 4. Under these conditions, the amide nitrogen is often protonized and can thus act as a cationic antistatic. It is likely that this protonization also contributes to making the dispersions more stable. However, at higher pH values, e.g. 5–6, the amide group is not protonized, and the amide is thus not cationic in nature. For applications in which an absence of skin irritation is not important, e.g. for technical applications such as carpet fibres, these amides are therefore often used at a low pH. This is also related to the fact that a low pH tends to prevent microbial growth and reduces the possibility of gasfading discolouration in textiles.

In the present invention, in which it is important to avoid skin irritation, such amides are preferably used at higher pH values to avoid acid-induced skin irritation. In cases in which some acid is necessary to stabilize an emulsion or dispersion, it is preferred to use acetic acid or another volatile acid which will at least partly evaporate during the drying step of the stretching process so that the pH of the coating on the finished fibres is sufficiently high to avoid acid induced skin irritation.

The cationic antistatic agent of the present invention should therefore have a pH (in a 10% aqueous solution) of not less than 4.0. More preferably, the pH is not less than 4.5, e.g. between 4.5 and 6.5, such as 5.0–6.0.

A further factor that can lead to skin or eye irritation in cationic antistatic agents of the quaternary ammonium salt type is the presence of free secondary and tertiary amine end groups. Preferred cationic antistatic agents for use according to the present invention are thus end group modified with long alkyl chains.

The cationic antistatic agents of the invention are therefore preferably selected from compounds with fatty acid amide end groups, tertiary long chain amine end groups or ester groups, in particular compounds of the general formula I

I

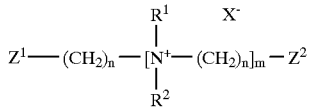

wherein $Z^1$ and $Z^2$ are Alk—CONH—, $(Alk)_2$—N—, Alk—COO—, or H, wherein Alk is a linear aliphatic alkyl or alkenyl group containing 10–24 carbon atoms or a mixture of more than one such group, with the proviso that both $Z^1$ and $Z^2$ cannot be H; $R^1$ is H, $CH_3$, alkyl with up to 24 carbon atoms, or a dimethylene fatty acid ester; $R^2$ is H or $CH_3$; n is an integer greater than 0; m is an integer greater than 0; and $X^-$ is a counterion. With the exception of the above proviso, i.e. that $Z^1$ and $Z^2$ cannot both be H, $Z^1$ and $Z^2$ may be the same or different, and are preferably the same.

Other possibilities for modifying the end groups are by use of ether or ethoxy groups, e.g. compounds of the general formula II

II

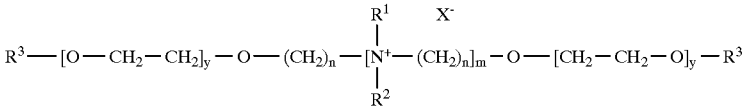

wherein $R^1$ is H, $CH_3$, alkyl with up to 24 carbon atoms, or a dimethylene fatty acid ester; $R^2$ is H or $CH_3$; each $R^3$ is independently H, methyl, ethyl or Alk-carbonyl, where Alk is a linear aliphatic alkyl or alkenyl group containing 10–24 carbon atoms or a mixture of more than one such group; n is an integer greater than 0; m is an integer greater than 0; y is an integer greater than 0; and $X^-$ is a counterion.

In the above compounds of formulas I and II, Alk is in particular an alkyl group containing 12–22 carbon atoms, preferably 14–20 carbon atoms, e.g. 16–18 carbon atoms; n is typically 1–4; when $R^3$ is alkyl, it is preferably alkyl with 10–24 carbon atoms; m is typically 1–10; y is typically 1–20; and $X^-$ is typically an acetate, citrate, lactate, metasulfate or chloride ion.

The cationic antistatic agents will often be in the form of oligo-cationic compounds, i.e. compounds with several quaternary ammonium groups, typically less than 10 such groups, since a higher number would result in polycationic components having a high viscosity, thereby leading to problems obtaining a uniform distribution of the spin finish on the fibres. Antistatic compounds for use in the present invention will therefore typically have a molecular weight of at least 500 but less than 10,000, preferably less than 5000, more preferably less than 2000.

A common characteristic of the cationic antistatic agent used according to the present invention is that they are non-irritant compounds. The term "non-irritant" refers to the fact they would be classified as "non-irritant" in a skin irritation test or an eye irritation test. Among the test methods available are those of the OECD Guideline No. 404: "Acute Dermal Irritation/Corrosion", May 1981, and the OECD Guideline No. 405: "Acute Eye Irritation/Corrosion", Feb. 1987, performed on rabbits. Classification can be according to that described in the Official Journal of the European Communities, L 257, 1983.

The second spin finish may contain a certain minimum amount of the antistatic agent to provide the fibres with sufficient antistatic properties to be able to be carded without problems of static electric build-up, but it may also, depending on the nature of the hydrophobic lubricant used in the second spin finish as well as the antistatic agent used in the first spin finish, be free of an antistatic agent.

The viscosity of the spin finish dispersions is influenced by the size of the dispersed particles or droplets. A small particle size thus generally provides a low viscosity, which enables the obtainment of a thin and uniform coating of the spin finish components on the fibre surface. This in turn provides the fibres with uniform fibre/fibre and fibre/metal friction characteristics, which allows a uniform texturization in the crimper and subsequently the production of a uniform carding web during carding. The end result is a consistent nonwoven material with good hydrophobicity. It is important to note, however, that ultrafine particles, e.g. with a diameter of less than about 0.1 $\mu$m, can lead to an increased viscosity. The particle size in the spin finish dispersions is therefore preferably in the range of 0.1–5 $\mu$m, more preferably 0.1–2 $\mu$m.

In general, the average size of the dispersed particles should be significantly less than the fibre diameter. For typical fine fibres with a diameter of e.g. 15–20 $\mu$m, this means that the particle size in the spin finish dispersions is preferably at the most about 5 $\mu$m, more preferably at the most about 2 $\mu$m, more preferably at the most about 1 $\mu$m. As a rule of thumb, the average particle size should normally be at least about one order of magnitude smaller than the diameter of the fibres, although this depends to a certain degree on the nature of both materials.

The desired small particle size of the dispersed particles can be accomplished in two ways. The first of these is by use of a relatively large amount of emulsifier. However, this is undesirable since it leads to problems of increased hydrophilicity, which for obvious reasons is undesired in hydrophobic fibres. The second way that a small particle size may be obtained, and that which is preferred, is by means of mechanical methods during preparation of the dispersions, such as use of special homogenizing devices, high shear dispersion devices or high speed mixers.

While it is desired that the amount of emulsifier is kept to a minimum, emulsifiers aid in the creation and maintainance of a stable dispersion of very small dispersed particles (typically with an average size of less than 2 $\mu$m) or of a stable emulsion with droplets, and are therefore generally necessary as such in limited amounts. The emulsifier is therefore typically present in an amount of less than 10% by weight, more typically less than 8% by weight, such as 4–7% by weight. Ideally, the amount of emulsifier is as small as possible or even completely eliminated. In the latter case, with no emulsifier or only a very small amount (e.g. less than 5% by weight) of an emulsifier, an anti-coalescent agent such as ligninosulfate may be added. Another reason for maintaining the amount of emulsifier as low as possible is that this helps to ensure that phase inversion takes place as intended (see below regarding phase inversion).

The emulsifier should for obvious reasons not be particularly hydrophilic, and it is clear that it must be compatable in terms of electric charge with the chosen antistatic agent(s) and hydrophobic lubricants(s). Suitable emulsifiers are for example fatty acid alkyl esters, fatty acid alkyl amides, alkyl ethers and ethoxylated long chain alcohols (fatty alcohols). More generally, preferred emulsifier compounds contain a cationic group with one or two (preferably two) fatty acid chains, e.g. with 8–22 carbon atoms, typically 12–20 carbon atoms, more typically 16–18 carbon atoms. These may be saturated or unsaturated, although saturated fatty acid chains are preferred. Commercially available products are often mixtures containing emulsifier compounds with fatty acid chains of different lengths, as in coconut oil, palm oil, etc.

As explained above, the viscosity of the spin finishes is preferably as low as possible. In particular, the viscosity of the second spin finish is preferably at the most 7 mPa.s, more preferably at the most 5 mPa.s, more preferably at the most 3 mPa.s, most preferably at the most 2 mPa.s, as determined e.g. by viscosimetry at 23° C. and a shear rate of 2.0 $sec^{-1}$ using a viscosimeter of the couvette type.

It is important that after application of the spin finishes, which are in the form of dispersions or emulsions in water, with water as the continuous phase, the active compounds in the spin finishes are able to dissipate into a uniform layer on the fibre surface. In order for this to take place, the temperature must be above the melting point of the main active compound in the dispersion, and enough water must evaporate to provoke a phase inversion. The phase inversion can take place before the crimper using steam or infrared radiation as a heat source, and should at the latest take place in the drying oven after crimping. However, it is preferred that phase inversion takes place before crimping, since this results in a uniform distribution of the spin finish components at an early stage, which means that the fibre/metal friction will be constant for the filaments, resulting in a uniform texturization. Also, this improves the web uniformity in the subsequent carding process, which ultimately leads to improved hydrophobic properties, in particular improved strike-through time, in the finished nonwovens. A further advantage of ensuring a uniform and high degree of texturization is that this is a prerequisite for high speed carding.

An antifoaming agent may be added to the antistatic agent. The antifoaming agent is e.g. a silicone compound, for example a dimethylsiloxane or a polydimethylsiloxane, and is typically added in an amount of less than 1% by weight, more typically less than 0.5% by weight, such as about 0.25% by weight. Other non-silicone based antifoaming agents may also be used.

The nature of the process dictates certain limits on the relative amounts of any wax, fatty acid amide condensation product or polydiorganosiloxane present as a hydrophobic lubricant. An excessive amount of wax or fatty acid amide condensation product will increase fibre/fibre friction and in particular fibre/metal friction in the crimper, leading to increased development of heat and a risk of the filaments becoming melted together and ruined. The friction conditions will also be detrimental for high speed carding. It is important that the friction-induced development of heat during carding is kept to a minimum, in particular when carding at high speeds. An excessive amount of polydiorganosiloxane will reduce friction in the crimper and during carding. Fibres with an excessive amount of polydiorganosiloxane will be slippery and difficult to stretch and card. Such fibres are also difficult to texturize in the crimper, since this requires a certain minimum fibre/metal friction.

Similarly, it is clear that considerations of hydrophobicity dictate certain limits on the relationship between the amount of antistatic agent on the one hand and the hydrophobic lubricants on the other hand.

The spin finish in the spinning section (first spin finish) should thus be an antistatic and lubricating finish that is as hydrophobic as possible. For lubrication purposes it may optionally contain a hydrophobic lubricant of the fatty acid amide condensate type. When a fatty acid amide condensate is used in the second spin finish, it is preferred to also include a fatty acid amide condensate in the first spin finish.

The "hydrophobic lubricant" is selected from i) a fatty acid amide condensation product, ii) a hydrocarbon wax, and iii) a polydiorganosiloxane. The definitions of these terms are explained in detail in the following. Note, however, that the term "hydrophobic lubricant" refers to compounds that exert an influence on the friction (fibre/fibre and fibre/metal friction) of the fibres, and that the "lubricant" can also refer to compounds, in particular waxes, that increase friction.

The term "fatty acid amide condensation product" refers to compounds based on mono- and diamines, in particular compounds of the general formula III

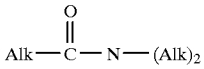

III and compounds of the general formula IV

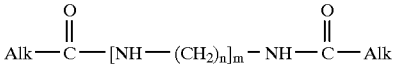

IV wherein each Alk is independently a linear aliphatic alkyl or alkenyl group containing 10–24 carbon atoms or a mixture of more than one such group, n is an integer greater than 0, and m is an integer greater than 0. In the compounds of formulas III and IV, Alk is in particular an alkyl group containing 12–22 carbon atoms, preferably 14–20 carbon atoms, e.g. 16–18 carbon atoms; n is typically 1–4; and m is typically 1–10.

The fatty acid amide condensation products are often mixtures with different molecular weights, and the alkyl chains, which are typically from natural fatty acid mixtures, are often of varying chain length. Also, such compounds may contain small amounts of non-reacted fatty acids or amines. The melting range of these components differs depending on structure and molecular weight. For the purposes of the present invention, melting points in the range of 40–100° C. are preferred, in particular 60–90° C.

The hydrocarbon wax used in the second spin finish of the present invention is in particular a paraffin wax or microcrystalline wax. However, it is also contemplated that natural waxes, i.e. an insect or plant wax, may also be suitable.

Paraffin wax is a crystalline hydrocarbon mixture which is solid at room temperature and which is obtained from the light petroleum fraction known as "pressable wax distillate". Paraffin wax normally consists mainly of straight-chained hydrocarbons and some branched-chain hydrocarbons (isoparaffins). Microcrystalline wax, which is also a hydrocarbon mixture that is solid at room temperature, is obtained from heavy petroleum distillates and residues. Microcrystalline wax normally consists mainly of branched-chain hydrocarbons (isoparaffins) and naphthenes (large side chains) along with small amounts of straight-chain hydrocarbons and aromatic hydrocarbons.

The melting point of paraffin waxes is typically in the range of about 45–65° C., while that of microcrystalline waxes is typically in the range of about 50–95° C. (The solidifying point of a hydrocarbon wax is normally about 2–3° C. below the melting point).

In the context of the present invention the term "hydrocarbon wax" refers to a paraffin or microcrystalline wax of natural or synthetic origin, in particular to a wax with a melting point in the range of 40–120° C., e.g. 40–90° C., corresponding to an average molecular weight of about 250–900 (as determined by high temperature gel permeation chromatography, using e.g. trichlorobenzene as an eluent, or by mass spectroscopy), or to a mixture of waxes containing a major proportion of a paraffin or microcrystalline wax and having a melting point in the above-mentioned range. While a wax or wax mixture with a relatively low melting point (i.e. about 40–80° C.) is preferred according to the present invention to ensure that the wax may be easily and uniformly distributed on the surface of the fibres without use of excessively high temperatures, it is, however, also contemplated that wax or wax mixtures having a higher melting point, e.g. up to about 120° C., will also be suitable for certain applications. Preferred hydrocarbon waxes have in particular a melting point in the range of 50–80° C., corresponding to an average molecular weight in the range of about 400–800, e.g. a melting point in the range of 55–75° C. For waxes lying within these preferred temperature ranges, the second spin finish is typically applied at a temperature in the range of 25–60° C., e.g. 40–55° C. (the fibres generally having a somewhat higher temperature during application of the second spin finish).

Since waxes normally consist of a mixture of different hydrocarbons, this will also be the case for the waxes used for the purpose of the present invention. The "wax" will therefore typically be a mixture of different wax types, some of which may be waxes having higher or lower molecular weights and melting points than those given above, as long as the melting point of the total mixture lies within the range stated above.

The wax may also contain a certain amount of a "hydrocarbon resin", i.e. a partially cross-linked hydrocarbon wax with a relatively high melting point, e.g. up to about 120° C. Hydrocarbon resins are prepared synthetically by radical polymerisation of hydrocarbon waxes containing aromatic hydrocarbons.

For wax mixtures containing other components than a hydrocarbon wax with a melting point in the range of 40–80° C., e.g. a hydrocarbon wax with a higher melting point or a hydrocarbon resin, the amount of these other components will typically comprise no more than 40% by weight of the wax mixture, preferably no more than 30% by weight of the wax mixture, more preferably no more than 20% by weight of the wax mixture.

As mentioned above, it is also contemplated that natural insect or plant waxes may also be used as the wax component in the second spin finish of the present invention. While natural waxes may contain a variety of different components, hydrocarbons are a major component in many of these. One natural wax of interest is beeswax, which contains a mixture of hydrocarbons, monoesters, diesters, triesters, hydroxy-monoesters, hydroxypolyesters, free acids, acid monoesters and acid polyesters, as well as a small amount of unidentified material. Other insect waxes of interest are for example those from crickets, grasshoppers and cockroaches.

The waxes of many plant species contain a major proportion of hydrocarbons, mainly in the form of unbranched alkanes with an odd number of carbon atoms. However, branched alkanes as well as alkenes have also been reported and are probably present in many plant waxes. Also, some vegetable waxes, such as carnauba wax, contain a relatively small percentage of unbranched alkanes. Like the animal waxes, plant waxes also contain various amounts of other components, including monoesters, diesters, hydroxyesters, polyesters, primary and secondary alcohols, acids, aldehydes, ketones, etc.

Natural waxes used for the purpose of the present invention should have a melting point which lies within the ranges given above for hydrocarbon waxes.

It has been found according to the invention that fibre/fibre and fibre/metal friction properties can be regulated, and the hydrophobic properties can be improved, when the second spin finish contains a polydiorganosiloxane (silicone) compound.

Thus, the second spin finish may optionally contain a small amount, e.g. up to 15% by weight, preferably less than 10% by weight, e.g. 1–8% by weight, typically 2–5% by weight, based on the total active content of the second spin finish, of a silicone compound. For fibres designed for use in nonwovens in which a very high degree of hydrophobicity is desired, and where a high carding speed is not crucial or necessary, the content of the silicone component may be higher, e.g. up to 10% by weight or 15% by weight. Higher levels, e.g. up to 20–25% by weight, will, however, tend to result in slippery fibres with a very low fibre/metal friction which can only be processed using a carefully selected combination of the other spin finish components.

The polydiorganosiloxane is in particular a polydialkylsiloxane of the general formula V,

V

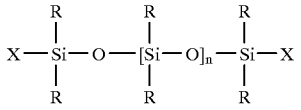

in which each R is independently an alkyl group containing 1–4 carbon atoms, phenyl or H, n is a number in the range of 500–3000, and X is OH, methyl, ethyl, H, O-methyl or O-acetyl. A preferred polydialkylsiloxane is polydimethylsiloxane.

The hydrophobic properties of the fibres can also be expressed in terms of the contact angle between water and the surface of the fibres. Fibres with non-wettable characteristics should have a contact angle of more than 90° (as measured e.g. using the Wilhelmy technique-force measurement for single fibre wettability). It is believed that relatively less hydrophobic fibres of the present invention will have a contact angle of slightly above 90°, while the highly hydrophobic fibres will have a contact angle that approaches 180° (a contact angle of 180° being a theoretical maximum for total non-wetting).

Control of the fibres' processing characteristics, i.e. fibre/fibre and fibre/metal friction, may be obtained by varying the amount of polydiorganosiloxane in the second spin finish. Fibres without any polydiorganosiloxane will have a high fibre/fibre and fibre/metal friction.

As mentioned above, one of the major advantages of the fibres of the present invention is that they are suitable for high-speed carding, this being of particular interest for polypropylene fibres. Thus, the fibres of the present invention may be processed to a uniform carding web at high speeds in the carding machine, e.g. at least about 80 m/min, typically at least 100 m/min, such as at least 150 m/min, and (in particular for polypropylene fibres) in many cases at least 175 m/min or even 225 m/min or more. The carding speed chosen in each case will depend on factors such as the type of fibre (e.g. polypropylene, polyethylene, bicomponent, etc.) and the nature of the nonwoven being produced. Carding will typically be by means of a dry-laid carding process.

Polypropylene fibres according to the invention are preferably able to be carded, at a carding speed of at least 100 m/min, preferably at least 150 m/min, more preferably at least 200 m/min, into a web which can be thermally bonded to a nonwoven in which the ratio between the tensile strength in the machine direction and the tensile strength in the cross direction is at the most 7, preferably at the most 5 (the strengths being determined as explained below). Polypropylene/polyethylene bicomponent fibres of the present invention are preferably able to be carded, at a carding speed of at least 80 m/min, preferably at least 100 m/min, into a web which can be thermally bonded to a nonwoven in which the ratio between the tensile strength in the machine direction and the tensile strength in the cross direction is at the most 6. Polyethylene fibres of the present invention are preferably able to be carded, at a carding speed of at least 80 m/min, into a web which can be thermally bonded to a nonwoven in which the ratio between the tensile strength in the machine direction and the tensile strength in the cross direction is at the most 5. In all cases, the randomization of fibres in the web expressed as the ratio between the two tensile strengths should be as close to 1 as possible.

The strengths of different nonwoven materials may be compared by using a so-called "bondability index", which compensates for differences in fibre randomization and which is calculated as explained below on the basis of nonwoven tensile strength measured in the machine direction and the cross direction. A standardized carding test for determining the tensile strength of nonwovens is performed as follows:

From about 95–105 kg of fibres, webs of a least 15 kg with a base weight of 20–25 g/m$^2$ fibre web are produced by carding at the chosen speed at optimum roller settings with respect to evenness of the web. The webs are subsequently thermobonded, the individual webs being thermobonded at different temperatures at intervals of typically 2° C. within a range chosen according to the type of fibres. For polypropylene fibres, a web with a base weight of about 20 g/m$^2$ is prepared by thermobonding at temperatures in the range of 145–157° C., using a calender pressure of 64 N/mm and a typical carding speed of 100 m/min. For polyethylene fibres, a web with a base weight of about 25 g/m$^2$ is prepared by thermobonding at temperatures in the range of 126–132° C., with a calender pressure of 40 N/mm and a typical carding speed of 80 m/min. For bicomponent fibres with a polypropylene core and a polyethylene sheath, a web with a base weight of about 20 g/m$^2$ is prepared by thermobonding at temperatures in the range of 137–147° C., with a calender pressure of 40 N/mm and a typical carding speed of 80 m/min. The tensile strengths of the webs are then determined in the machine direction and the cross direction, the measurements being performed according to the EDANA recommended test: Nonwovens Tensile Strength, Feb., 20, 1989, which is based on ISO 9073-3:1989 ("Determination of tensile strength and elongation"); however, for the purposes of the present invention the relative humidity was between 50% and 65%. Finally, a bondability index is calculated for each of the bonding temperatures, the bondability index being defined as the square root of the product of the machine direction strength and the cross direction strength. In order to arrive at a standard bondability index for a standard nonwoven base weight of 20 g/m$^2$ ($BI_{20}$), the calculated bondability index for a given sample is multiplied by 20 and divided by the actual base weight in g/m$^2$, thereby compensating for the fact that the strength of a nonwoven varies with the base weight.

For polypropylene-based fibres, the bondability index ($BI_{20}$) should be at least 15 N/5 cm when carded at a speed of 100 m/min and at least 10 N/5 cm when carded at a speed of 150 m/min, and is preferably at least 17 N/5 cm when carded at a speed of 100 m/min and at least 10 N/5 cm when carded at a speed of 150 m/min.

For polyethylene-based fibres, the bondability index ($BI_{20}$) should be at least 7 N/5 cm when carded at a speed of 80 m/min, and is preferably at least 10 N/5 cm when carded at a speed of 80 m/min.

For sheath-and-core type bicomponent fibres having a polypropylene-based core and a polyethylene-based sheath, the bondability index ($BI_{20}$) should be at least 8 N/5 cm when carded at a speed of 80 m/min, and is preferably at least 10 N/5 cm at 80 m/min.

The viscosities of the spin finishes can be determined using a Brookfield Viscosimeter model LVT DVII equipped with a UL-adaptor. This is a viscosimeter of the couvette type (concentric cylinder, or cup & bob geometry), and even low viscosity spin finishes can be measured at different shear rates. The viscosities are determined at 23° C. and a shear rate of 2.0 sec$^{-1}$.

The hydrophobic properties of nonwovens prepared from the fibres of the invention may be tested according to various methods. These include a repellency test, a test for liquid absorbency time, a test for liquid strike-through time and a runoff test. The test for liquid absorbency time may also be used for testing the hydrophobic properties of fibres, as described below.

The repellency test is performed according to the EDANA recommended test for nonwovens repellency (No. 120.1-80), with conditioning of the samples for at least 2 hours at a temperature of 23° C. and a relative humidity of 50%. This test involves measuring the pressure (expressed as cm water column) required to effect water penetration through a nonwoven subjected to an increasing water pressure. Briefly, a circular section of a nonwoven sample of the desired base weight (typically about 22 g/m$^2$) with a diameter of 60 mm is subjected to a water column whose height increases at a rate of 3 cm/min., and the repellency of the nonwoven is determined as the height of the water column at the moment when the third drop of water penetrates the sample.

In the above repellency test, nonwovens containing the fibres of present invention should show a repellency of at least 1.5 cm. For nonwovens prepared from fibres with a medium degree of hydrophobicity, the repellency should be at least 2.5 cm, typically at least 3.0 cm. For nonwovens containing highly hydrophobic fibres the repellency should be at least 3.5 cm, more preferably at least 4.0 cm, e.g. at least about 5.0 cm.

Another suitable test method for determining the hydrophobic properties of nonwovens is a test for liquid absorbency time according to the EDANA recommended test for nonwovens absorption (No. 10.1-72). This test involves determining the time required for the complete wetting of a specimen strip (5 g) loosely rolled into a cylindrical wire basket (3 g) and dropped onto the surface of the liquid (typically water) from a height of 25 mm. Nonwoven samples for use in this test are for the purpose of the present invention conditioned for at least 2 hours at a temperature of 23° C. and a relative humidity of 50%.

The above liquid absorbency test may also be used, with certain minor amendments, for determining the hydrophobic properties of fibres. For determining the absorbency of fibres, a carding web with a base weight of approximately 10 g/m$^2$ is prepared from the fibres to be tested by carding at 15 m/min., and samples having a weight of 5 g are then taken from the web. The remainder of the test is carried out according to the EDANA test procedure (10.1-72). When testing either nonwovens or fibres, the absorbency time is defined as the time interval from the moment the wire basket containing the nonwoven or fibre sample hits the liquid to the moment the sample is completely immersed under the surface of the liquid.

In the above test for liquid absorbency in water, the wetting time (i.e. the sinking time) for a sample of hydrophobic fibres should be at least about 1 hour, preferably at least about 2 hours, more preferably at least about 4 hours. For highly hydrophobic fibres the wetting time should be at least about 24 hours.

A further test for determining the hydrophobic properties of nonwovens is a test for liquid strike-through time (EDANA recommended test: Nonwoven coverstock liquid strike-through time (simulated urine); No. 150.2-93). In this test, the time required for a known volume of liquid to pass through a nonwoven is measured. The liquid is applied to the surface of a test piece of nonwoven coverstock with the embossed side upwards which is in contact with an underlying standard absorbent pad. The test is designed to compare the strike-through time of different nonwoven coverstocks.

The nonwoven samples are for the purpose of the present invention conditioned for at least 2 hours at a temperature of 23° C. and a relative humidity of 50%. 5 ml of the test liquid (a 0.9% aqueous NaCl solution, "simulated urine") is discharged onto the sample (typical base weight 22 g/m$^2$), and the time required for the liquid to penetrate the nonwoven is measured electronically.

In the liquid strike-through test, nonwovens according to the present invention should have a strike-through time of at least about 20 sec, preferably at least about 60 sec, more preferably at least 120 sec. For nonwovens containing highly hydrophobic fibres the strike-through time is preferably at least about 5 min.

The hydrophobicity of nonwovens may further be determined by evaluating the runoff percentage according to the following procedure:

Runoff is measured using "synthetic urine" (68–72 dyne/cm; 19.4 g urea, 8 g NaCl, 0.54 g $MgSO_4$ (anhydrous), 1.18 g $CaCl_2.6H_2O$, 970.9 g demineralised water). The test involves pouring 25 ml of test liquid in 3.75 sec. onto a test material (31 cm in the machine direction and 14 cm in the cross direction) containing a top layer of a nonwoven coverstock and a bottom layer of filter paper, the test material being placed at angle of 10 degrees from horizontal and a collecting tray being placed under the lower end of the test material. The coverstock should be placed in the machine direction with the embossed side upwards. The runoff percentage is defined as the amount of test liquid which is collected in the tray, expressed as a percentage of the original 25 ml of liquid. A good hydrophobic nonwoven should using this method give a runoff of at least 95%. For materials with superior hydrophobic properties, the runoff percentage is preferably at least 98%, and can be as high as 99% or more (which essentially corresponds to 0% penetration). In addition to the hydrophobicity of the fibres used to prepare the nonwoven, the runoff percentage is also to a certain extent dependent upon the weight of the material, a heavier material giving a slightly higher runoff percentage, the above-mentioned runoff percentages being based on nonwovens with a base weight of 20 g/m$^2$.

EXAMPLES

Fibres and nonwovens were prepared as follows:

The polyolefin raw material (polypropylene) was spun into fibres by conventional spinning (long spinning) technology, using spinning speeds of 1500–2000 m/min, resulting in a bundle of several hundred filaments. After quenching of the filaments by air cooling, the filaments were treated by means of a lick roller with a first spin finish containing the antistatic agents mentioned below.

The dispersions of the first spin finish were prepared primarily by mixing the proprietary mixtures Novostat 1105 or Beistat LXO (from CHT R. Beitlich, GmbH, Germany) or the proprietary mixtures Silastol VP33G213/1 or VP33G213/2 (from Schill & Seilacher GmbH, Germany) in various ratios. The amount (active content based on the weight of the fibres) applied at this stage varied somewhat, but generally about 0.06–0.11% of the Novostat or Beistat products was applied, and about 0.12–0.16% of the VP33G213 products. Also, about 0.07–0.12% of a hydrophobic lubricant (Novolub 2440 or Beilub 6993, CHT R. Beitlich GmbH, Germany) was applied in the first spin finish in a number of cases, and in Example 10 about 0.20% of the hyrophobic lubricant Beilub 6995 (CHT R. Beitlich GmbH, Germany) was applied in the first spin finish.

The Novostat/Beistat products contain mainly a quaternary ammonium salt with end groups functionalized with fatty acid amides. They correspond to compounds covered by the general formula I above in which $Z^1$ and $Z^2$ are Alk—CONH—. The counterion in these products is acetate. The major difference between the two types of products is their pH, Beistat having a pH of 5–6 and Novostat having a pH of 4 at an active content of 10%.

The VP33G213 products each contain two cationic antistatic agents, both of which are quaternary ammonium salts with end groups functionalized with fatty acid amides, corresponding to compounds encompassed by the general formula I above in which $Z^1$ and $Z^2$ are either Alk—CONH— or $(Alk)_2$—N—. Different counterions have been used, including acetate, chloride and metasulfate.

Note that all of the antistatic products are in fact product mixtures, a part of which may not be totally reacted in the condensation process.

The Novolub/Beilub products contain mainly a fatty acid amide condensate corresponding to compounds covered by the general formula IV above, the melting point of the condensate being about 80° C. The main difference between the two products is their particle size, Novolub having an average particle size of about 3–8 μm. whereas Beilub has a submicron (<1 μm) average particle size. The Beilub product has a pH of 5–6 and Novolub a pH og about 4–5 at 10% active content.

In comparative Examples 1 and 3 the antistatic agent was anionic and consisted of a neutralized $C_{16}$–$C_{18}$ alcohol phosphoric acid ester, the major part of which was a neutralized stearyl alcohol phosphoric acid ester (Silastol F203, Schill & Seilacher GmbH, Germany).

The filaments were off-line stretched in a two-stage drawing operation using a combination of hot rollers and a hot air oven, with temperatures in the range of 115–135° C. The stretch ratios were generally in the range of from 1.05:1 to 1.5:1. The stretched filaments were then treated (by means of a lick roller) with different second spin finishes. The second spin finishes were aqueous dispersions containing varying amounts of hydrophobic lubricants, and in certain cases cationic antistatic agents. In two examples (3 and 8), the second spin finish also contained polydimethylsiloxane (silicone).

For the hydrophobic lubricants of the fatty acid amide condensation type (Examples 2, 4, 5, 8, 9 and 10), the dispersions were, except as otherwise noted, prepared using the proprietary mixtures Novolub 2440, Beilub 6993 or Beilub 6995. Example 2 also contained Novostat 1105. In Example 8, Beilub 6993 was mixed with a cationic emulsified polydimethylsiloxane in the form of the proprietary mixture ZWP73 (CHT R. Beitlich GmbH, Germany), and in Example 3 the polydimethylsiloxane was present in the form of the proprietary mixture Silastol 5072 (Schill & Seilacher GmbH, Germany). The typical amount of hydrophobic lubricant (and any antistatic agent) applied in the second spin finish was 0.15–0.35% by weight of the fibres.

For the hydrophobic lubricants of the wax type (Examples 6 and 7), the dispersions were prepared by using the proprietary mixtures VP33G216 as the wax component, which in certain cases was mixed with VP33G213/2 as an antistatic agent (all from Schill & Seilacher GmbH, Germany). The typical amount of the wax component (and any antistatic agent) applied was about 0.5% by weight of the fibres. The wax component itself was a hydrocarbon wax mixture containing mostly a linear saturated hydrocarbon wax with a melting point of 55° C. and an average molecular weight of about 500.

The filaments were then crimped in a stuffer-box crimper and subsequently annealed in an oven at a temperature of about 125° C. to reduce contraction of the fibres during the thermal bonding process and to allow the hydrophobic components of the second spin finish to become uniformly distributed on the surface of the filaments. Staple fibres were then produced by cutting the filaments to the desired length.

All fibres were of polypropylene, with a fineness of 2.2–2.4 dtex for Examples 1–9 and 1.7 dtex for Example 10, a fibre tenacity of 1.8–2.1 cN/dtex, an elongation at break of 350–420%, and a cut length of 41 or 45 mm. The fineness of the finished fibres was measured according to DIN 53812/2, the elongation at break and tenacity of the fibres was measured according to DIN 53816, and the crimp frequency was measured according to ASTM D 3937-82.

Nonwovens were prepared from the various fibres by carding at various speeds and thermally bonding the webs at various temperatures (see Table 2). For each nonwoven, the tensile strength and elongation was measured in both the machine direction and the cross direction as described above (i.e. using the EDANA recommended test), and a bondability index was calculated as described above on the basis of the measured tensile strengths. For comparison purposes, the bondability indices were converted as explained above to an index for a standard nonwoven with a base weight of 20 $g/m^2$ ($BI_{20}$). In addition, the runoff percentage, strike-through and repellency were also determined, the methods used also being those described above.

The cardability, i.e. the suitability of the fibres for carding was determined using a simple web cohesion test. This test is carried out by measuring the length a thin carding web of approximately 10 $g/m^2$ can support in a substantially horizontal position before it breaks due to its own weight, the length of the carding web being increased at a rate of about 15 m/min. This it performed by taking the carding web off the card in a horizontal direction at a speed of 15 m/min, which is the carding speed used for this test.

A higher cardability as a result of a higher fibre/fibre friction gives a higher web cohesion length. The fibre/fibre friction is dependent upon factors such as the composition of the second spin finish and the degree of texturization, as well as how permanent the texturization is. Fibre/metal friction is also important for the cardability; if it is either too high or too low, the fibres are difficult to transport through the card.

Polyolefin fibres which are well suited for carding will typically be able to support about 1.5 m or more, e.g. 1.5–2.5 m, in the above-described web cohesion length test. Fibres designed for high speed carding should preferably be able to support somewhat more, i.e. at least about 2.0 m.

In the tables below, the fibre properties of a number of different fibres prepared as described above are given, along with the properties of nonwovens prepared from these fibres.

Table 1 shows, in addition to the type of fibre, the following characteristics of the fibres: amount of first and second spin finish applied (active content, in percent by weight of the fibres), total amount of spin finish applied (total active content in percent by weight of the fibres), the viscosity of the second spin finish, the composition (active content) of the total spin finish applied (percent by weight antistatic agent, hydrophobic lubricant and silicone; the remainder of the active content up to 100% being an emulsifier), number of crimps per 10 cm, the web cohesion length and the liquid absorbency time of the fibres.

Table 2 shows the following characteristics of nonwovens prepared from the fibres of Table 1: carding speed (m/min), bonding temperature (° C.), maximum tensile strength in the machine direction (MD-max; N/5 cm), maximum tensile strength in the cross direction (CD-max; N/5 cm), maximum bondability index (BI-max), standard bondability index ($BI_{20}$), base weight (g/m$^2$), runoff percentage, repellency (cm), strike-through and a rough classification of the cardability.

TABLE 1

Fibre data

| Nr. | 1st spin finish % | 2nd spin finish % | Total spin finish % | Viscosity of 2nd spin finish cSt | Anitstatic agent % | Hydrophobic lubricant % | Silicone % | Crimps per 10 cm | Web cohesion length m | Liquid absorbency time |
|---|---|---|---|---|---|---|---|---|---|---|
| 1* | 0.16 | 0.49 | 0.65 | 3.5 | 51.5[x] | 40.1[#] | 0 | 105 | 1.75 | 6–10 min |
| 2* | 0.15 | 0.35 | 0.50 | 34 | 31.0 | 63.4 | 0 | 106 | 2.75 | 4 h |
| 3* | 0.16 | 0.47 | 0.63 | 2.5 | 34.3[x] | 37.7[#] | 16.7 | 89 | 1.75 | >24 h |
| 4a | 0.17 | 0.30[2] | 0.47 | 7.0 | 20.2 | 73.6 | 0 | 106 | 1.50 | >24 h |
| 4b | 0.15 | 0.15[2] | 0.30 | 2.3 | 18.7 | 75.3 | 0 | — | 1.75 | >24 h |
| 5a | 0.20 | 0.33[2] | 0.53 | 5.5 | 14.0 | 74.5 | 0 | 111 | 2.00 | 1 h |
| 5b | 0.18 | 0.20[2] | 0.38 | 2.6 | 19.5 | 74.2 | 0 | 126 | 2.25 | 4.5 h |
| 5c | 0.20 | 0.20[2] | 0.40 | 2.3 | 21.0 | 72.8 | 0 | 109 | 2.00 | >24 h |
| 6 | 0.15[1] | 0.50 | 0.65 | — | 26 | 68[#] | 0 | — | 1.75 | — |
| 7a | 0.15[1] | 0.50 | 0.65 | 1.4 | 26.5 | 68.0[#] | 0 | 92 | 1.75 | >24 h |
| 7b | 0.15[1] | 0.50[2] | 0.65 | 1.4 | 21.5 | 72.3[#] | 0 | — | 2.00 | >24 h |
| 8 | 0.19 | 0.20[2] | 0.39 | 1.7 | 14.5 | 63.4 | 4.7 | — | 1.75 | — |
| 9 | 0.20 | 0.20[2] | 0.40 | 2.3 | 21.0 | 72.8 | 0 | 112 | 2.25 | 4 h |
| 10 | 9.31 | 0.20[2] | 0.51 | — | 16.4 | 77.4 | 0 | 92 | 1.75–2 | >24 h |

* = comparative example
[x] = anionic antistatic agent with ethoxylated castor oil as lubricant
[#] = wax as hydrophobic lubricant
[1] = no hydrophobic lubricant in 1st spin finish
[2] = no antistatic agent in 2nd spin finish
— = not measured

TABLE 2

Nonwovens data (fibres of Table 1)

| Nr. | Line Speed m/min. | Bonding temp. (° C.) | Strength MD-max N/5 cm | Strength CD-max N/5 cm | BI-max N/5 cm | $BI_{20}$ N/5 cm | Base Weight g/m$^2$ | Run-off % | Repellency cm water column | Strike through (sec.) | Cardability |
|---|---|---|---|---|---|---|---|---|---|---|---|
| 1* | 100 | 149 | 38.1 | 8.3 | 19 | 18 | 20.9 | 94 | 1.5 | 7.5 | Good |
| 2* | 100 | 151 | 37.8 | 10.2 | 19.6 | 17.4 | 22.6 | 93 | 0.5 | 10.8 | Good |
| 3a* | 100 | 153 | 35.7 | 11.7 | 19.1 | 17.4 | 22.4 | 100 | 6.5 | >300 | Good |
| 3b* | 151 | 154 | 24.6 | 5.7 | 11.8 | 10.8 | 22.0 | 100 | 6.5 | 41 | Good |
| 4a | 100 | 155 | 47.5 | 11.8 | 23.7 | 21.3 | 22.2 | 100 | 4.3 | >300 | (Good) |
| 4b | 100 | 153 | 58 | 10.0 | 24.1 | 21.4 | 22.5 | 100 | 4.6 | >300 | (Good) |
| 5a | 100 | 153 | 29.8 | 10.2 | 17.4 | 17.1 | 20.4 | 100 | 1.5 | 22 | Good |
| 5b | 100 | 153 | 34.5 | 9.5 | 18.1 | 15.7 | 23.0 | 100 | 3.0 | >300 | Good |
| 5c | 100 | 151 | 32.1 | 8.7 | 16.7 | 14.4 | 23.2 | 100 | 4.1 | >300 | (Good) |
| 6 | 100 | 155 | 49.5 | 9.1 | 21.2 | 17.9 | 23.7 | — | 1.3 | 80[x] | Good |
| 7a | 100 | 157 | 55 | 11.1 | 24.7 | 21.7 | 22.7 | 100 | 3.2 | 206[x] | Good |
| 7b | 100 | 153 | 45.2 | 12.4 | 23.7 | 19.8 | 23.9 | 100 | 5.0 | >300 | (Good) |
| 8 | 100 | 151 | 41.8 | 15.6 | 25.5 | 23.4 | 21.8 | 100 | 5.3 | >300 | (Good) |
| 9a | 200 | 153 | 31.4 | 5.6 | 13.3 | 11.7 | 21.6 | — | 2.1 | 25 | Good |
| 9b | 230 | — | — | — | — | — | — | — | — | — | Uneven |
| 10 | 100 | 153 | 50.0 | 10.1 | 22.4 | 19.4 | 23.1 | — | 3.8 | >300 | Good |

* = comparative example
— = not measured
(Good) = good cardability, but slightly static on winder (after carding)
[x] = large variation in individual measurements In the following, some additional comments regarding the various tests are provided:

Example 1 (Comparative Example)

A silicone-free fibre prepared using spin finishes with anionic antistatic agents (a neutralized $C_{16}$–$C_{18}$ alcohol phosphoric acid ester, the major part of which was a neutralized stearyl alcohol phosphoric acid ester). Web cohesion length 1.75 m.

A comparison of Example 1 with Examples 4, 5 and 7 shows the effect of going from an anionic to a cationic antistatic agent when the fibres are not treated with a silicone component to improve their hydrophobic properties. The liquid absorption time of the fibres is increased from about 10 minutes (Example 1) to from 1 hour to over 24 hours for the other examples. For nonwovens, the water repellency is increased from 1.5 cm to 3–5 cm, and strike-through from less than 10 seconds to over 300 seconds (note that all the strike-through tests are discontinued after 300 seconds, if the liquid has not penetrated the nonwoven). Thus, replacing the anionic antistatic agent with a cationic antistatic agent resulted in a dramatic improvement in the hydrophilic properties.

Example 2 (Comparative Example)

Fibre prepared using an antistatic agent in the second spin finish, which had a very high viscosity (34 mPa.s), and which formed a significant amount of stable foam that gave problems in applying the correct amount. This also resulted in a poor distribution of spin finish on the fibre surface, which may be seen in the results for hydrophobicity of the fibre (liquid absorption time) and the nonwoven (strike-through 11 seconds, water repellency 0.5 cm). These values are much poorer than e.g. Examples 4 and 8, in which the viscosity is much lower.

Example 3 (Comparative Example)

A silicone-containing fibre prepared using the same anionic antistatic agent as in Example 1 and a large amount of silicone. The fibre has a good hydrophobicity, but a limited web cohesion, and therefore only a moderate cardability. A "normal" carding speed of 100 m/min gave good hydrophobicity (strike-through >300 sec), while a somewhat higher carding speed of 151 m/min resulted in a significantly lower strike-through of only about 41 sec, due to the poor distribution of the fibres in the carding web. The web cohesion length was 1.75 m.

A comparison of Example 3 with Examples 4, 5b and 5c shows the effect of using a cationic antistatic agent without silicone or with only a small amount of silicone. In all of these examples, the hydrophobic properties are very good, with a water repellency of over 3 cm and a strike-through of over 300 seconds (although the strike-through was only 41 seconds for the nonwoven prepared from the fibres of Example 3b carded at 151 m/min), but the use of a cationic antistatic agent and no silicone or only a small amount of silicone in the latter examples gave a greater fibre friction. This may be seen by the fact that the greater web cohesion of Examples 5b and 5c (2.25 and 2.0 m, respectively, compared to a maximum of 1.75 m in Example 3). As for Example 4, it should be noted that while the web cohesion values given in Table 1 are not higher than the value given for Example 3, this is due to the fact that the nonwovens of Example 3 were prepared using the maximum possible crimper box pressure, while those of Example 4 were prepared using close to the minimum crimper box pressure. Thus, use of a higher crimper box pressure in Example 4 would have resulted in web cohesion values comparable to those of Examples 5b and 5c.

Improved fibre friction allows a higher carding speed: for example maximum 151 m/min for the fibres of Example 3, while the fibres of Example 9 could be carded at 200 m/min to high quality, uniform nonwovens, and could also be carded at 230 m/min. Although the hydrophobic properties of the fibres of the invention (e.g. those of Example 9a) at very high carding speeds are not quite as good as at slightly lower speeds, they are still acceptable for many applications.

Example 4

The spin finish mixtures were used in different amounts. Good hydrophobicity, although hydrophobicity was poorer with increased viscosity of the spin finishes. The fibres are produced under conditions that give a good liquification of the hydrophobic lubricant in the drying oven (after crimping), i.e. a temperature sufficiently above the melting temperature of the lubricant to ensure thorough melting of the lubricant component.

Example 5

Differences in texturization due to differences in particle size, viscosity and crimper box pressure give differences in hydrophobicity in nonwovens, even though the properties of the fibres themselves are otherwise nearly the same.

Example 5 shows fibres prepared using steam heating after application of the second spin finish, but before the crimper. This gave an increased fibre/fibre friction, as expressed by web cohesion, which in turn allows a higher carding speed. Furthermore, a low viscosity of the second spin finish (Examples 5b and 5c) resulted in excellent hydrophobic properties (strike through and repellency).

Example 6

Example 6 shows fibres treated with a cationic emulsified wax component as the hydrophobic lubricant. The hydrophobic properties are moderately good. Compared to the similar fibre of Example 7b, the addition of a relatively small amount of antistatic agent to the second spin finish of Example 6 gave poorer results.

Example 7

Two cationic antistatic mixtures were used in the first spin finish, with the same wax component being used in the second spin finish. In Example 7a the second spin finish contained an antistatic agent (VP33G213/2), while the second spin finish of Example 7b did not. Both fibres and nonwovens showed good to excellent hydrophobic and strength properties, with 7b being slightly better in terms of hydrophobicity than 7a.

Example 8

Similar to Examples 4 and 5, although with a small addition of a cationic emulsified polydimethylsiloxane. Addition of the silicone gave slightly improved hydrophobicity.

Example 9

High speed carding test. Good web uniformity and hydrophobicity at 180–200 m/min. Web cohesion length 2.25 m. Compare with Example 3, in which the fibres could not be carded at more than 151 m/min, and which even then showed poor web formation. The fibres of this example were prepared under conditions similar to those of Example 5c, but were texturized under conditions that gave higher fibre/fibre friction (higher crimper box pressure) The fibres could be carded at 230 m/min. to a somewhat less uniform web than that obtained at 200 m/min.

Example 10

In this example, a relatively large amount (0.20%) of hydrophobic lubricant of the fatty acid amide type was applied to fine (1.7 dtex) fibres in the first spin finish, which gave a uniform coating of the hydrophobic lubricant on the fibres. During application of the first spin finish the width of the fibre tow is greater than during application of the second spin finish, and a better distribution of the lubricant can therefore be obtained by applying it in the first spin finish.

Applying to fine dtex fibres an amount of spin finish similar to that applied to fibres with a higher dtex gave a better spin finish coverage of the fibres and improved uniformity in nonwoven materials produced from these fibres. The relatively high content of hydrophobic lubricant in the first spin finish gave an improved cohesion and better processability of the fibres during carding.

Fine dtex fibres can also be combined with other fibres having a higher dtex to provide good product processability.

We claim:

1. A method for producing cardable, hydrophobic staple fibres of a polyolefin or a copolymer thereof, the method comprising the following steps:

a. applying to spun filaments a first spin finish comprising at least one cationic antistatic agent, b. stretching the filaments, c. applying to the stretched filaments a second spin finish in the form of a dispersion comprising at least one hydrophobic lubricant selected from i) a fatty acid amide condensation product based on mono- and/or diamines and fatty acid chains containing 10–24 carbon atoms and ii, a hydrocarbon wax, d. crimping the filaments, e. drying the filaments, and f. cutting the filaments to obtain staple fibres.

2. A method according to claim 1 wherein the first spin finish further comprises, as a hydrophobic lubricant, a fatty acid amide condensation product based on mono- and/or diamines and fatty acid chains containing 10–24 carbon atoms.

3. A method according to claim 1 wherein the second spin finish further comprises a cationic antistatic agent in an amount of at the most 20% by weight, based on the total active content of the second spin finish.

4. A method according to claim 1 wherein the cationic antistatic agent is a quaternary ammonium salt selected from compounds of the general formula I

I

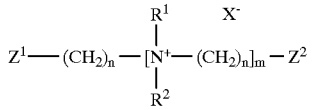

wherein $Z^1$ and $Z^2$ are Alk—CONH—, $(Alk)_2$—N—, Alk—COO—, or H, wherein Alk is a linear aliphatic alkyl or alkenyl group containing 10–24 carbon atoms or a mixture of more than one such group, with the proviso that both $Z^1$ and $Z^2$ cannot be H; $R^1$ is H, $CH_3$, alkyl with up to 24 carbon atoms, or a dimethylene fatty acid ester; $R^2$ is H or $CH_3$; n is an integer greater than 0; m is an integer greater than 0; and $X^-$ is a counterion;

and compounds of the general Formula II

II

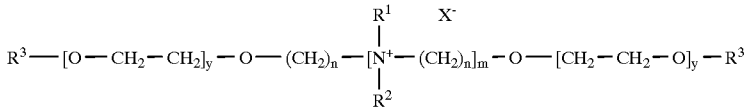

wherein $R^1$ is H, $CH_3$, alkyl with up to 24 carbon atoms, or a dimethylene fatty acid ester; $R^2$ is H or $CH_3$; each $R^3$ is independently H, methyl, ethyl or Alk—carbonyl, where Alk is a linear aliphatic alkyl or alkenyl group containing 10–24 carbon atoms or a mixture of more than one such group; n is an integer greater than 0; m is an integer greater than 0; y is an integer greater than 0; and $X^-$ is a counterion.

5. A method according to claim 4 wherein Alk is an alkyl group containing 14–20 carbon atoms; n is 1–4; when $R^3$ is alkyl, it is alkyl with 10–24 carbon atoms; m is 1–10; y is 1–20; and $X^-$ is an acetate, citrate, lactate, metasulfate or chloride ion.

6. A method according to claim 1 wherein the second spin finish has a viscosity of at the most 5 mPa.s, as determined by viscosimetry at 23° C. and a shear rate of 2.0 $sec^{-1}$ using a viscosimeter of the couvette type.

7. A method according to claim 1 wherein the dispersed hydrophobic lubricant in the second spin finish is in the form of particles or droplets with an average size in the range of 0.1–5 $\mu$m.

8. A method according to claim 1 wherein the hydrophobic lubricant is a fatty acid amide condensation product selected from compounds of the general formula III

III

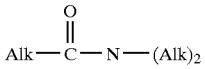

and compounds of the general IV

IV

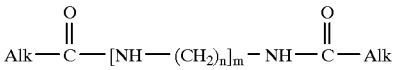

wherein each Alk is independently a linear aliphatic alkyl or alkenyl group containing 10–24 carbon atoms or a mixture of more than one such group, n is an integer greater than 0, and m is an integer greater than 0.

9. A method according to claim 8 wherein Alk is an alkyl group containing 14–20 carbon atoms; n is 1–4; and m is 1–10.

10. A method according to claim 1 wherein the cationic antistatic agent has a pH in a 10% aqueous solution of not less than 4.0.

11. A method according to claim 1 wherein the cationic antistatic agent has a molecular weight of at least 500 and less than 10,000.

12. A method according to claim 1 wherein the hydrophobic lubricant in the second spin finish is a natural or synthetic hydrocarbon wax with a melting point in the range of 40–120° C., or a wax mixture comprising at least one such hydrocarbon wax and having a melting point in the range of 40–120° C.

13. A method according to claim 12 wherein the hydrocarbon wax or wax mixture has a melting point in the range of 40–90° C.

14. A method according to claim 1 wherein the total amount of spin finish applied to the fibres (weight active content based on the weight of the fibres) is at the most 0.6%.

15. A method according to claim 1 wherein the total amount of cationic antistatic agent applied to the fibres (weight active content based on the weight of the fibres) is at the most 0.15%.

16. A method according to claim 1 wherein the second spin finish comprises an emulsifier in an amount of less than 10% by weight, based on the active content of the second spin finish.

17. A method according to claim 1 wherein the second spin finish further comprises a polydiorganosiloxane in an amount of up to 15% by weight.

18. A method according to claim 17 wherein the second spin finish comprises a polydialkylsiloxane of the general formula V,

V

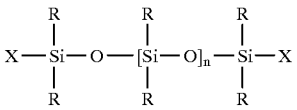

in which each R is independently an alkyl group containing 1–4 carbon atoms, phenyl or H, n is a number in the range of 500–3000, and X is OH, methyl, ethyl, H, O-methyl or O-acetyl.

19. A method according to claim 18 wherein the polydialkyl-siloxane is polydimethylsiloxane.

20. A method according to claim 1 wherein the fibres are produced by a long spinning process.

21. A method according to claim 1 which includes a heating step after application of the second spin finish and prior to crimping, the temperature being above the melting point of the hydrophobic lubricant.

22. A method according to claim 1 wherein the fibres are polypropylene fibres.

23. A texturized, cardable, staple fibre of a polyolefin or a copolymer thereof prepared according to the method of claim 1.

24. A texturized, cardable, staple fibre of a polyolefin or a copolymer thereof carrying, at its surface, a spin finish coating comprising at least one cationic antistatic agent and at least one hydrophobic lubricant selected from i) a fatty acid amide condensation product based on mono- and/or diamines and fatty acid chains containing 10–24 carbon atoms and ii) a hydrocarbon wax, the fibre being texturized to a level of about 5–15 crimps/cm such that it is able to be carded continuously at a speed of 150 m/min. to a nonwoven material showing at least one of the following characteristics:

a) a strike-through time of at least 20 sec, as determined by the EDANA recommended test for nonwoven coverstock liquid strike-through time (No. 150.2-93)

b) a repellency of at least 1.5 cm, as determined according to the EDANA recommended test for nonwovens repellency (No. 120.1-80), the nonwoven samples having been conditioned for at least 2 hours at a temperature of 23° C. and a relative humidity of 50% prior to testing; and c) a runoff percentage of at least 95%, as determined by pouring 25 ml of simulated urine onto a test material (31 cm in the machine direction and 14 cm in the cross direction) containing a top layer of a nonwoven coverstock with a base weight of 20 g/m$^2$ and a bottom layer of filter paper, the test material being placed at angle of 10 degrees from horizontal and a collecting tray being placed under the lower end of the test material, the coverstock being placed in the machine direction with the embossed side upwards, the runoff percentage being the amount of test liquid which is collected in the tray expressed as a percentage of the original 25 ml of liquid.

25. A texturized, cardable, stable fibre of a polyolefin or a copolymer thereof carrying, at its surface, a spin finish coating comprising at least one cationic antistatic agent and at least one hydrophobic lubricant selected from i) a fatty acid amide condensation product based or mono- and/or diamines and fatty acid chains containing 10–24 carbon atoms and ii) a hydrocarbon wax, the fibre having a liquid absorbency time of at least about 1 hour, as determined according to the EDANA recommended test for nonwovens absorption (No. 10.1-72) on samples taken from a carding web with a base weight of approximately 10 g/m$^2$ prepared by carding at 15 m/min, the samples having been conditioned at a temperature of 45° C. and at a relative humidity of less than 10% for one hour prior to testing and allowed to cool to 23° C. before testing.

26. A texturized, cardable, fibre of a polyolefin or a copolymer thereof carrying, at its surface, a spin finish coating comprising at least one cationic antistatic agent and at least one hydrophobic lubricant selected from i) a fatty acid amide condensation product based on mono- and/or diamines and fatty acid chains containing 10–24 carbon atoms and ii) a hydrocarbon wax, the fibre having a web cohesion of at least 1.75 m, as determined by a web cohesion test carried out by measuring the length a carding web of 10 g/m$^2$ can support in a substantially horizontal position before it breaks due to its own weight, the length of the carding web being increased at a rate of 15 m/min.

27. A fibre according to claim 24 wherein the spin finish coating is substantially free of any polydiorgano-siloxane compound, the fibre being texturized to a level of about 5–15 crimps/cm such that it is able to be carded continuously at a speed of 100 m/min. to a nonwoven material having a base weight of 23 g/m$^2$ and showing at least one of the following characteristics:

a) a strike-through time of at least 120 sec; and b) a repellency of at least 3.0 cm.

28. A hydrophobic nonwoven material comprising the fibres according to claim 23.

29. A method for preparing a hydrophobic nonwoven material, comprising processing fibres according to claim 23 to obtain a web for bonding, and thermobonding the resulting web to obtain the hydrophobic nonwoven material.

30. A method according to claim 6 wherein the second spin finish has a viscosity of at the most 3 mPa.s.

31. A method according to claim 10 wherein the cationic antistatic agent has a pH in a 10% aqueous solution in the range of 4.5–6.5.

32. A fibre according to claim 24 which is able to be carded continuously at a speed of 150 m/min. to a nonwoven material showing at least one of the following characteristics:

a) a strike-through time of at least 120 sec;

b) a repellency of at least 2.5 cm; and c) a runoff percentage of at least 98%.

33. A fibre according to claim 25 which has a liquid absorbency time of at least about 4 hours.

* * * * *

UNITED STATES PATENT AND TRADEMARK OFFICE

CERTIFICATE OF CORRECTION

PATENT NO. : 5,958,806

DATED : September 28, 1999

INVENTOR(S) : Arne JENSEN, Katharine DYRMOSE-JENSEN, Lydia Dahl CLAUSEN, Bjorn MARCHER

It is certified that error appears in the above-identified patent and that said Letters Patent is hereby corrected as shown below:

Column 17, line 48 after "of" (first occurrence) insert --the--;
Column 19, line 49 delete "og" and insert --of--;
Table 1, first column header, delete "Nr." and insert --No.--;
Table 1, sixth column header, delete"Anitstatic" and insert --Antistatic--;
Table 1, line 10, second column, delete "9.31" and insert --0.31--;
Table 2, first column header, delete "Nr." and insert --No.--;
Column 27, line 1, after "general" insert --formula--;
Column 28, line 43, delete "or" (first occurrence) and insert --on--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*